US008511931B2

(12) United States Patent
Klotz et al.

(10) Patent No.: US 8,511,931 B2
(45) Date of Patent: Aug. 20, 2013

(54) TRANSVERSE JUNCTION COMPRISING TWO FACING TRANSVERSE ENDS OF TWO SUCCESSIVE PREFABRICATED CARRIAGEWAY ELEMENTS, AND CONNECTING SYSTEM THEREFOR

(75) Inventors: Martin Klotz, Gresswiller (FR); Jean-Luc Andre, Molsheim (FR)

(73) Assignee: Lohr Industrie, Hangenbieten (FR)

( * ) Notice: Subject to any disclaimer, the term of this patent is extended or adjusted under 35 U.S.C. 154(b) by 0 days.

(21) Appl. No.: 13/498,340

(22) PCT Filed: Oct. 1, 2010

(86) PCT No.: PCT/FR2010/000656

§ 371 (c)(1),
(2), (4) Date: Jun. 8, 2012

(87) PCT Pub. No.: WO2011/039436

PCT Pub. Date: Apr. 7, 2011

(65) Prior Publication Data

US 2012/0243937 A1 Sep. 27, 2012

(30) Foreign Application Priority Data

Oct. 2, 2009 (FR) ..... 09 04710

(51) Int. Cl.
*E01C 11/02* (2006.01)

(52) U.S. Cl.
USPC ..... 404/40; 404/48; 404/51; 404/56

(58) Field of Classification Search
USPC ..... 404/40, 47, 49, 51, 56, 59, 62, 63, 404/66; 14/73.1
See application file for complete search history.

(56) References Cited

U.S. PATENT DOCUMENTS

| | | | | |
|---|---|---|---|---|
| 784,925 | A * | 3/1905 | Crawford | 52/742.16 |
| 1,456,259 | A * | 5/1923 | Ito | 404/40 |
| 1,912,429 | A | 6/1933 | Burgess | |
| 2,370,153 | A * | 2/1945 | Fischer | 404/64 |
| 2,723,607 | A | 11/1955 | Paquin-Kleinermann | |
| 3,217,616 | A * | 11/1965 | Maxon, Jr. | 404/59 |
| 3,238,856 | A * | 3/1966 | Jahn | 404/51 |
| 4,564,311 | A | 1/1986 | Scales | |
| 4,824,289 | A * | 4/1989 | Glang et al. | 405/152 |
| 4,958,964 | A * | 9/1990 | Soto et al. | 404/40 |
| 6,688,808 | B2 * | 2/2004 | Lee | 404/40 |
| 8,206,059 | B1 * | 6/2012 | Southgate et al. | 404/60 |

FOREIGN PATENT DOCUMENTS

DE 805 649 C 5/1951

* cited by examiner

*Primary Examiner* — Gary Hartmann
(74) *Attorney, Agent, or Firm* — Davis & Bujold, PLLC

(57) ABSTRACT

A junction between successive flat pre-fabricated elements which comprises an elastic transverse insert (9), an approaching mechanism (10) in the form of tie beams (23) and tensioning mechanisms (19). The flat pre-fabricated elements (2) to be assembled each have a transverse channel (3) adapted so as to receive the insert along the end transverse edges (4, 5) thereof, which must face each other after assembly on the ground, and conduits (7) of the tie beams. Each pre-fabricated element is successively arranged, one after the other, and the transverse insert is introduced into the transverse housing (6) formed by transverse channels facing each other. The tie beams are introduced into the conduits, the ends thereof projecting outside the pre-fabricated elements. The tie beams are then tensioned by a tensioning mechanism, at each of the ends thereof, in order to immobilize the flat pre-fabricated elements and thereby connected by the tie beams.

24 Claims, 6 Drawing Sheets

TRANSVERSE JUNCTION COMPRISING TWO FACING TRANSVERSE ENDS OF TWO SUCCESSIVE PREFABRICATED CARRIAGEWAY ELEMENTS, AND CONNECTING SYSTEM THEREFOR

This application is a National Stage completion of PCT/FR2010/000656 filed Oct. 1, 2010, which claims priority from French patent application serial no. 09 04710 filed Oct. 2, 2009.

FIELD OF THE INVENTION

The present invention concerns a transverse junction between two successive flat prefabricated elements to be assembled on the ground in linear succession and essentially coplanar, comprising the two extremities facing the two successive prefabricated elements and the connecting system. More specifically, the invention relates to a connecting system comprising a transverse insert and a means for guiding the prefabricated roadway elements that will be assembled on the ground.

BACKGROUND OF THE INVENTION

The goal of the invention is to furnish a means for joining flat prefabricated elements so they can be assembled on the ground, one after the other, and remain continuously coplanar over time. These flat prefabricated elements are preferably roadway elements made of concrete, but they may consist of any other flat prefabricated element, whether made of concrete, metal, wood, glass, plastic or other material.

Prefabricated concrete roadway elements are subjected to strong forces from passing vehicles, expanding and contracting according to outdoor temperature, and are generally placed on uncemented soil that changes with the weather depending on climatic conditions (ice, rain, etc.) and various vibrations and tremors. Thus, the ground undergoes different degrees of settling depending on its location. Consequently, prefabricated concrete roadway elements must be joined by a connecting system that takes these parameters into account and prevents the appearance of "steps" interfering with vehicle traffic.

Currently the system for connecting flat prefabricated elements consists of providing bolts mounted in openings provided for this purpose on the transverse end edges of the flat prefabricated elements that must be located opposite each other and in close proximity after assembly on the ground. Generally, according to this technique, each flat prefabricated element receives the attaching bolts on one of its transverse end edges, but there is no bolt housed in the openings situated on the other transverse end edge. Therefore, each flat prefabricated element has one extremity comprising male connections and another extremity comprising unattached female receptor openings. During assembly of the two successive flat prefabricated elements on the ground, a first flat prefabricated element is positioned on a flat portion of backfilled ground, using a crane, for example. Next the second flat prefabricated element is positioned on the ground close to and following the first one, for example, using the same crane, with the transverse end edges of the two flat prefabricated elements facing each other. Next, still using the same crane, the second element is moved longitudinally in translation toward the first one causing the male connectors on one to penetrate the female receptors on the other. The cooperation between the male connectors and the female receptors ensures the connection between the two flat prefabricated elements.

This prior art system for joining flat prefabricated elements has numerous disadvantages.

First, a high degree of precision is required to embed the male connectors of one flat prefabricated element in the female receptor orifices of the other flat prefabricated element, making the maneuvers extremely difficult, especially when the crane is manipulating very heavy flat prefabricated elements.

Additionally, this embedding process takes place by moving one flat prefabricated element along the ground in translation towards the other one. This displacement along the ground generally creates a pile of sand or dirt between the two elements, interfering with the process of joining them and making the ground susceptible to unevenness in that area.

In order to prevent water from infiltrating between two flat prefabricated elements and carrying sand as it trickles into the area where the elements are joined, this space is generally blocked by a flexible seal between the two flat prefabricated elements. This seal is usually formed by flowing liquid polymer between adjacent end edges of the two successive flat prefabricated elements. This is a delicate step that must be performed by different work crew than the crew that positioned the flat prefabricated elements and which requires drying time prior to manipulation, slowing progress on the work site.

Finally, the presence of connecting bolts between two flat prefabricated elements concentrates localized stress in the area surrounding each bolt, which may cause fissures and then breakage of the flat prefabricated elements in this area.

Similarly, the rigidness of this connecting system allows only a slight amount of play if the flat prefabricated elements move or swell, which can constitute an additional source of element breakage.

SUMMARY OF THE INVENTION

Because of this, a simple, quick system is needed for connecting two flat prefabricated elements that will be assembled on the ground which can take place immediately after the flat prefabricated elements are positioned, uses the same construction crew, requires no translational movement of the elements along the ground, is flexible enough to accommodate weather-related ground changes so the prefabricated flat elements can expand and contract freely, makes the assembled flat prefabricated elements watertight and limits the risk of breakage by the flat prefabricated elements.

To achieve a global solution to these technical problems, the junction, along with the connection system of the present invention, maintains the assembly of the two flat prefabricated elements to be assembled on the ground in linear succession, generally coplanar, to form a road surface, more specifically, a travel surface for road vehicles.

Each of the flat prefabricated elements to be assembled has at least one transverse edge, corresponding to its transverse extremity, and two lateral surfaces, with the at least one transverse end edge of one of the successive flat prefabricated elements being situated, after assembly, opposite that of the successive prefabricated element.

The junction with its connecting system according to the present invention comprises:

- at least one transverse housing formed by the junction of two transverse channels each formed in the at least one transverse end edge of the successive flat prefabricated elements;
- at least one passage conduit formed by associating the extensions of two conduits, each formed in one of the successive flat prefabricated elements and each opening on one end at the transverse end edge, and on the other end, at one of the lateral surfaces, upper or lower, of the prefabricated element;

at least one flexible transverse insert, designed to be placed in the at least one transverse housing, extending across essentially the entire width of at least one transverse housing, and at least one guiding means to be located inside at least one of the passage conduits;

tensioning means for the one or more guiding means; and means for maintaining the assembly of the two successive flat prefabricated elements.

The tensioning elements may also be elements for maintaining the tension and the assembly of the two successive flat prefabricated elements similar to a locking system.

According to one variation, the flexible transverse insert has at least one conduit passage traversing it which opens on one side, at the transverse end edge of one of the flat prefabricated elements; and on the other side, at the transverse end edge of the other flat prefabricated element to be connected, opposite the passage conduits formed in the flat prefabricated elements and opening on one side at their transverse end edge and on the other side at one of their lateral surfaces, upper or lower.

Each flat prefabricated element is positioned vertically following the other one facing it and immediately proximate to it, for example, using a crane; this operation may be facilitated by using a vertical guide element. The transverse insert is then introduced horizontally into the housing formed between two successive flat prefabricated elements by the horizontal channels that face each other.

The guiding means are then introduced into the passage conduits. In the case of where the guiding means are diagonal tie beams, the passage conduits cross, without splitting, for example, generally in the middle of the housing formed by the junction of two horizontal channels that face each other. The guiding means are designed to be long enough so their extremities extend beyond the flat prefabricated elements on one side at one of the lateral surfaces, upper or lower, of one of the flat prefabricated elements and on the other, at one of the lateral surfaces, upper or lower, of the other flat prefabricated element. These flat prefabricated elements may comprise lateral recesses allowing the ends of the guiding means to remain free. The guiding means are then subjected to tension by turning screws mounted on each of their extremities, thereby maintaining the tension and the connection between the flat prefabricated elements. It is preferable for a washer to be placed before the screw on the extremities of the guiding means to support the screw better on the concrete, prevent it from breaking apart when tightened, and sustain a flexible tightening force for maintaining tension.

The transverse insert is made of a watertight, relatively flexible material so that after slight compression, it seals the two flat prefabricated elements while still allowing for expansion without deteriorating. According to a preferred embodiment of the invention, the transverse insert may be made of rubber, polyurethane resin, or recycled tires.

Extending along the entire span of the flat prefabricated elements, this insert does not concentrate stress and, therefore, there is no risk of causing the slightest deterioration in the flat prefabricated elements.

Likewise, the elasticity or the shape of the transverse insert allows a certain degree of flexibility in the connection which permits the flat prefabricated elements to be positioned on slightly rounded or concave ground and allows the flat prefabricated elements to move along with the ground without breaking when the ground changes due to weather.

It could, therefore, be considered to be a low displacement pivot articulation for absorbing the various movements of the two prefabricated elements it connects.

Subjecting the guiding means to tension also permits the position of one prefabricated flat element to be precisely adjusted relative to the nearby element, thereby correcting any slight offset if the prefabricated flat elements to be joined are not exactly opposite each other.

Similarly, if there are two tie beams, by increasing the tension of the guiding means more on one side than the other, it is possible to assemble two flat prefabricated elements by forming a slightly broken angular line between the two, which can create a succession of prefabricated flat elements that form a curve over a large distance. If the tie beams are not horizontal, but angled, it is also possible to regulate the height of the extremities of the flat prefabricated elements, relative to one another, by increasing the tension on one guiding means.

Furthermore, the prefabricated flat elements are assembled by positioning them vertically without any need to move them horizontally in translation, which is a much simpler way to manipulate them and does not require the intervention of another work crew to form the connections.

Finally, if a prefabricated flat element deteriorates, it is very easy to replace it without any need to move the other prefabricated flat elements, which was impossible to do using the prior art technique.

BRIEF DESCRIPTION OF THE DRAWINGS

Other characteristics and features of the invention will be apparent from reading the following detailed description, taken with reference to the attached drawings, in which.

DETAILED DESCRIPTION OF THE PREFERRED EMBODIMENTS

Figure 1:
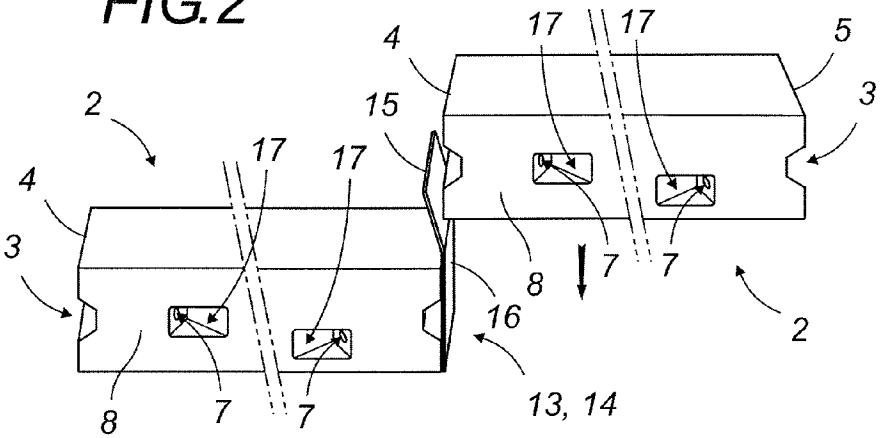
FIGS. 1 through 4 represent the steps of positioning one flat prefabricated element following another one, according to the method of the invention.

The junction, with its connecting system, will now be described in detail with reference to FIGS. 1 through 22. Equivalent elements shown in different drawings will bear the same reference numerals.

For the remainder of the description, the concepts of top and bottom, lower and upper, will be defined relative to the orientation adopted by the flat prefabricated elements, once they are positioned on the ground.

The connecting system 1 that is part of the present invention is provided for use in assembling flat prefabricated elements 2 on the ground in linear succession.

According to a preferred use of the invention, these flat prefabricated elements 2 are prefabricated road elements. FIGS. 19 through 22 show an exemplary use of the connecting system 1 of the invention for two prefabricated road elements for a vehicle on tires traveling on a central guide rail.

Figure 19:
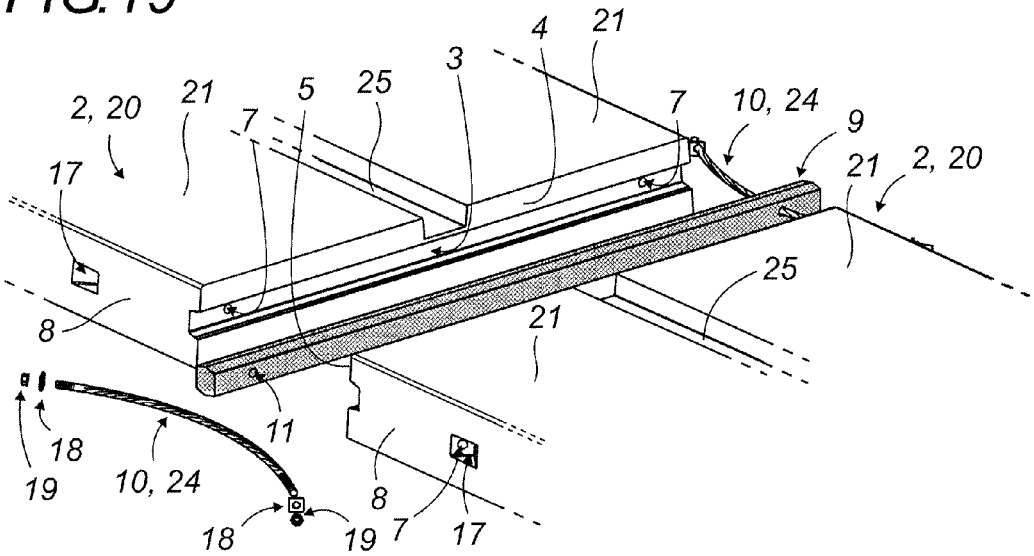
FIGS. 19 through 22 are perspective views showing the connecting system that is part of the invention used to assemble three different types of prefabricated elements of a travel pathway.

In the variation shown in FIG. 19, the prefabricated road elements 2, 20 each comprise two parallel concrete travel pathways 21 separated by one longitudinal central housing 25 for a rail. The prefabricated elements 2, 20 each have passage conduits 7 for guiding means 10 and a transverse horizontal trough-shaped channel 3 in which are respectively housed two guiding means 10 in the form of curved tie beams 24 and a transverse insert 9.

According to this embodiment, each prefabricated flat element 2 has at least four passage conduits 7 that serve as housings for guiding means 10, because at least two passage conduits 7 are oriented toward the front end transverse edge 4 and at least two passage conduits 7 are oriented toward the rear end transverse edge 5.

Figure 20:
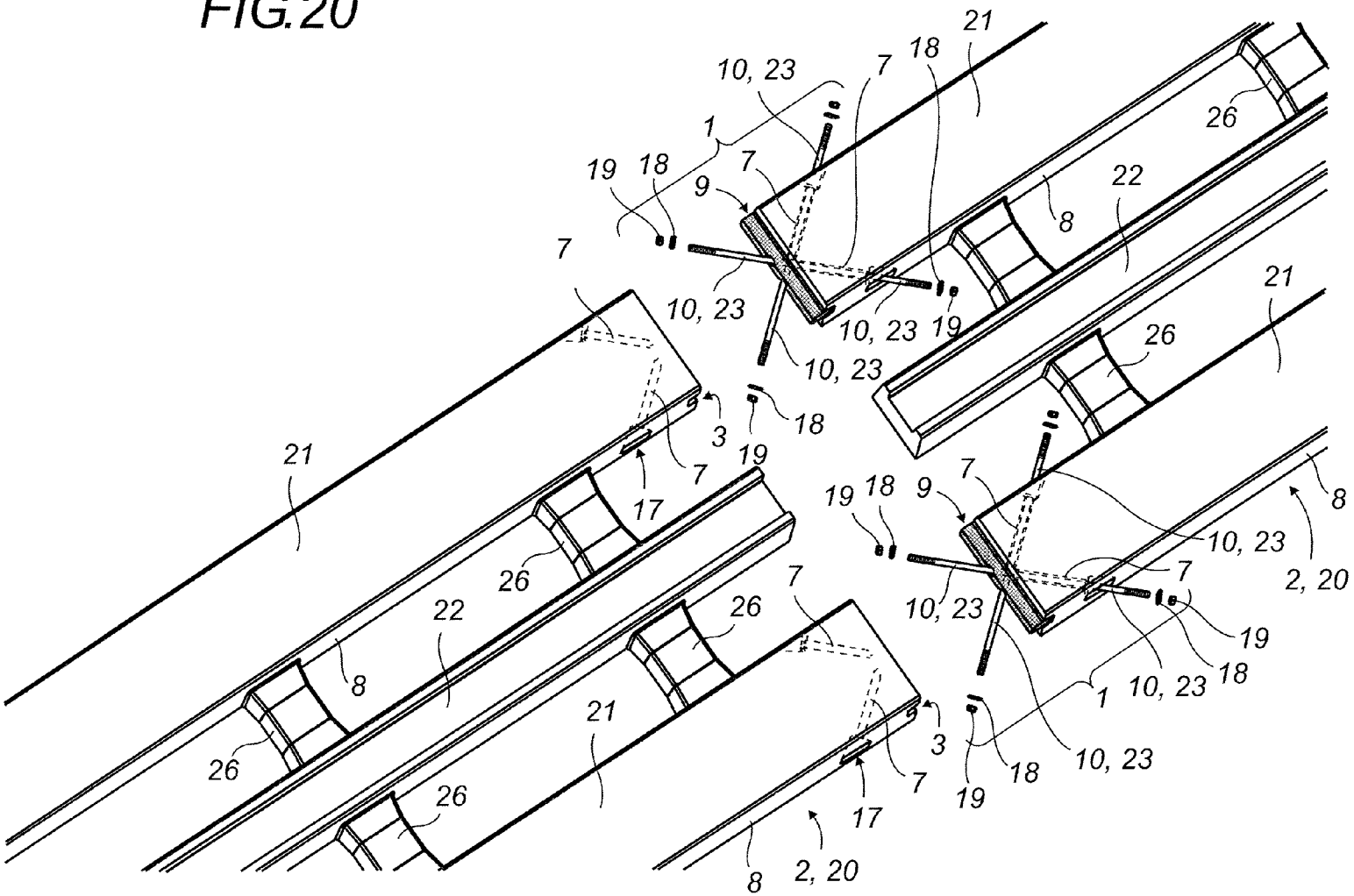

In the embodiment shown in FIG. 20, the prefabricated road elements 2, 20 each comprise two parallel concrete travel pathways 21 attached at a distance from a central support 22 to which a guide rail will eventually be attached. Each of the two concrete travel pathways 21 is connected to the central support 22 by transverse cross-pieces 26. Each concrete travel pathway 21 has passage conduits 7, for the guiding means 10, and a transverse horizontal trough-shaped channel 3 respectively housing two guiding means 10 in the form of diagonal tie beams 23 and a transverse insert 9.

Figure 21:
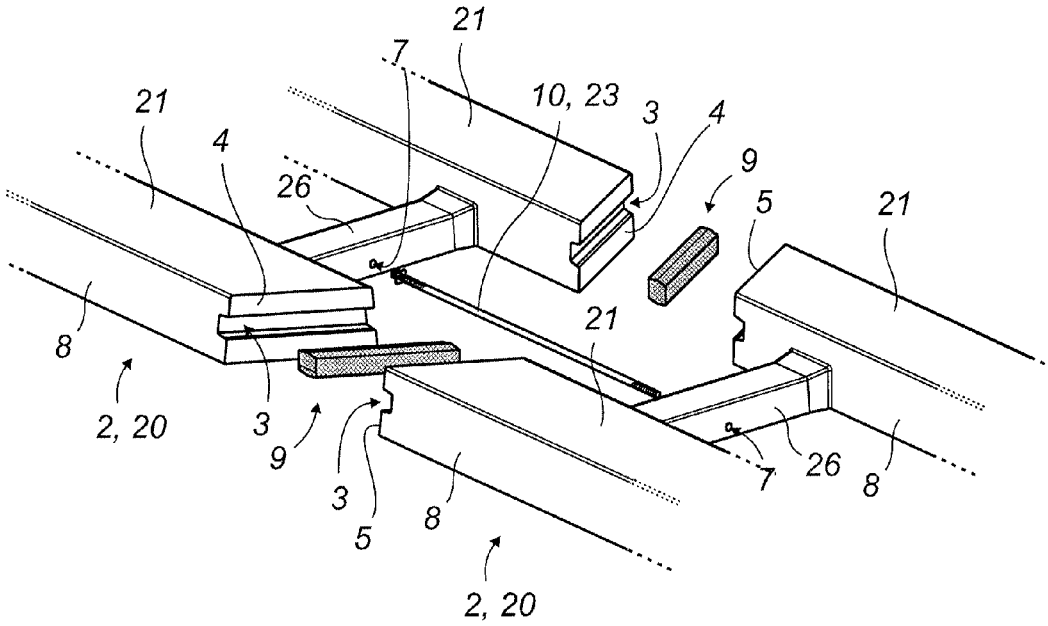
Figure 22:
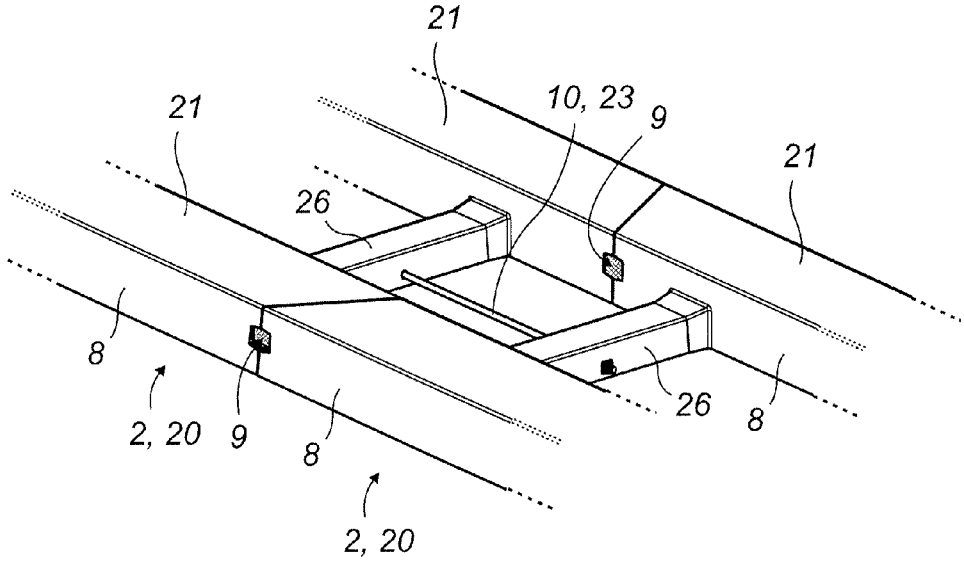

In the embodiment shown in FIGS. 21 and 22, the prefabricated road elements 2, 20 each have two parallel concrete travel pathways 21 located at a distance from each other and connected to each other by transverse cross-pieces 26. Each prefabricated element 2, 20 has at least one passage conduit 7 for the guiding means 10 in each of its transverse cross-pieces 26 which houses a guiding means 10 in the form of a straight longitudinal tie beam.

In this embodiment, the guiding means 10 in the form of a straight longitudinal tie beam 23 maintains and brings together the two flat prefabricated elements 2 by means of their transverse cross elements 26, allowing the two flat prefabricated elements to be very easily assembled on the ground in linear succession and essentially coplanar. Actually, when positioning flat prefabricated elements 2, access is gained to transverse cross pieces 26 and it is therefore very easy to introduce a straight longitudinal tie beam 23 into at least one of the passage conduits 7 present in each transverse cross piece 26 and then subject them to tension.

Each prefabricated flat element 2 has a transverse channel 3 that is trough-shaped or some other shape (round, polygonal, oval, square, etc.) on its front end edge 4 and on its rear end edge 5. There are two transverse end edges 4, 5 that must face each other in immediate mutual proximity to an analogous transverse edge 5, 4 of the nearby flat prefabricated element 2 after they are assembled on the ground one after the other. When yjr two flat prefabricated elements 2 are positioned end-to-end, their facing transverse channels 3 are preferably horizontal and each forms a transverse housing 6 that is preferably horizontal.

In the embodiment shown in FIGS. 21 and 22, each concrete travel pathway 21 has a trough-shaped transverse channel 3 on each of its oblique edges, front end edge 4 and rear end edge 5, which house a transverse insert 9.

The passage conduits 7 are preferably diagonal or arched. They preferably originate on one lateral surface 8 and terminate on the respective transverse front end edge 4 or rear end edge 5 so as to form passage conduits that are coaxial to those located across from them in the next prefabricated flat element. The passage conduits 7, for the guiding means 10, terminate essentially in the middle of the respective front end edge 4 or the rear end edge 5, but without splitting. The passage conduits 7 preferably are angled upward very slightly, from the horizontal, and preferably are vertically offset from one another so as to cross two by two without splitting.

When the two flat prefabricated elements 2 are positioned end-to-end, a passage conduit 27 is formed by associating the two extended opposing conduits 7 each formed in one of the successive flat prefabricated elements and each opening on one side at the transverse end edge 4, 5 and on the other side at one of the upper or lower lateral surfaces 8 of the prefabricated element 2.

The junction, according to the present invention, comprising a connecting system 1 is composed of a transverse insert 9 and at least one guiding means 10, but two in the exemplary embodiment shown.

The transverse insert 9 is provided for introduction into transverse channel 3 on transverse end edges 4, 5 which must be facing each other and in immediate proximity after assembly on the ground. It has at least two conduit passages 11 for tie beams, preferably diagonal and cylindrical, allowing guiding means 10 to cross over insert 9 when they are introduced into the prefabricated flat elements 2. As with prefabricated flat elements 2, the two conduit passages 11 in transverse insert 9 are preferably diagonal and cross over each other essentially in the middle of transverse insert 9 but without splitting.

The transverse insert 9 is preferably made of a flexible, watertight polymer material.

It is preferably hexagonal in section (see FIG. 12) or otherwise polygonal, although several other shapes for its section are possible. As shown in FIGS. 10 through 14, it is possible for the transverse insert 9 to be square, trapezoidal, round or oval in section.

By virtue of its shape, it is possible to precisely define the orientation of the transverse insert 9 in its transverse channel 3, ensuring that the two passage conduits 11 for the guiding means 10 of the transverse insert 9 are positioned across from and within the axis of the flat prefabricated elements 2 in order for the guiding means 10 to be introduced through the flat prefabricated elements 2 and the transverse insert 9. A mark on one of the end surfaces of the transverse insert 9 can also facilitate orientation for the user, said mark constituting an index that coincides with a corresponding index mark on the lateral surfaces 8 of the flat prefabricated elements 2, when the transverse insert 9 is introduced in the transverse channel 3 in the correct orientation.

The transverse insert 9 forms a connection between two successive flat prefabricated elements. It is preferably adapted to the shape of the transverse channel 3, preferably horizontal, and generally equal to or slightly smaller than the channel diameter in order to furnish a seal between the prefabricated flat elements 2 under all conditions.

In the situation where the flat prefabricated elements 2 are assembled on a bed of compacted fill, which is generally the case, the transverse insert 9 forms a barrier that prevents water from passing between two flat prefabricated elements 2 and eroding the sand in the fill; over time, this could create a recess in the ground under flat prefabricated elements 2.

The length of the transverse insert 9 preferably is generally equal to or slightly smaller than the length of the transverse channels 3, or rather the width of the prefabricated flat elements 2 if the channels 3 are horizontal. Because of its length, the transverse insert 9 does not concentrate stress locally in the flat prefabricated elements 2 and, therefore, there is no risk they will rupture.

Made of flexible material, the transverse insert 9 also forms a deformable articulation between two successive flat prefabricated elements 2, allowing them to adapt to the curvature of the ground and its eventual changes, or to the curvature desired for the travel pathway consisting of the succession of the flat prefabricated elements 2, however, without creating stress capable of causing breakage.

According to a preferred embodiment, the guiding means 10 are tie beams 23 with threaded ends, each receiving a screw, which may be made in various shapes.

According to a first embodiment of the invention, the guiding means 10 are in the form of conventional metal tie beams 23, for example straight metal pins each with a threaded portion 12 at each extremity. These tie beams 23 will be introduced into diagonal rectilinear passage conduits 7, 11, 27. They are preferably made of flexible metal so as to resume their initial shape after eventual deformation. The natural or forced immobilization of each screw ensures that the assembly is maintained.

According to a first embodiment of the invention, the tie beams 23 are in the form of arched metal rods comprising, for example, a threaded portion 12 at each extremity. These tie beams 23 will be introduced into curved passage conduits 7, 11, 27, which may be arched. They are preferably made of flexible metal so as to resume their initial shape after any eventual deformation and permit them to be subjected to flexible tension forces.

According to a third and a fourth embodiment of the invention, the guiding means 10 are flexible connectors 24 that may assume a rectilinear or curved shape, like the preceding tie beams. Each flexible connector 24 is formed of a metal strap with a solid threaded portion at each end.

The guiding means 10 have a sufficiently large diameter to resist the mechanical stress and forces to which they are subjected. Their diameter should not be excessively large, as this would require the various passage conduits 7, 11, 27 to be larger in diameter, thereby making flat prefabricated elements 2 and/or transverse insert 9 fragile.

Because of their generally long length, essentially of the order of double the width of the flat prefabricated elements 2 in the case of diagonal guiding means 10, the rigid guiding means 10 may be flexible to a certain extent, advantageously given them the ability to deform to a certain extent for connection between the two flat prefabricated elements 2 and for their constituent elements.

This freedom to deform, obtained regardless of the type of guiding means used, represents an important feature of the invention; among other things, it allows the formation of a deformable articulation between the flat prefabricated elements 2 as indicated previously, and it also allows expansion or contraction with temperature changes and flexion without breaking when stress is exerted on flat prefabricated elements 2. The connecting system 1 thus endures and "lives" along with the flat prefabricated elements 2 which it is used to assemble.

Other guiding means besides connectors are possible, for example, using a handle, a lever, or an exterior tool. A connection is then formed in some way, resulting in slight compression of the insert. Maintaining the insert results in blocking, which locks the assembly. The connection may be rigid or flexible with extremities immobilized by pins.

A preferred method of utilizing a connection system 1 will now be described in detail with reference to FIGS. 1 through 8. The example describes a connection system 1 comprising a hexagonal transverse insert 9, two tie beams 23 constituting the guiding means 10 in the form of straight metal rods with threaded extremities and tensioning means in the form of screws attached to the extremities of tie beams 23.

To save space in the drawings, flat prefabricated elements 2 are not shown in their entirety; the transverse dashed lines show a section of undefined length.

First, a guide element 13, for example, a metal plate 14 of predefined thickness, is placed vertically against the free transverse end edge of a flat prefabricated element already positioned on the ground (see FIG. 1). This guide element 13, 14 may have, for example, an upper portion 15 that is angled toward flat prefabricated element 2 already positioned on the ground, such that its free surface 16 serves as a vertical guide when the next flat prefabricated element 2 is positioned. The thickness of metal guide element 14 depends upon the spacing desired between two flat prefabricated elements 2 once assembled on the ground. This spacing is especially necessary to allow expansion by the flat prefabricated elements 2, during temperature changes. It preferably ranges from 1 to 20 millimeters and more preferably, from 3 to 5 millimeters. Therefore, it is preferable for the two transverse end edges 4, 5, facing the two successive flat prefabricated elements 2, not to be in direct contact after assembly, but in immediate proximity to each other.

Figure 2:
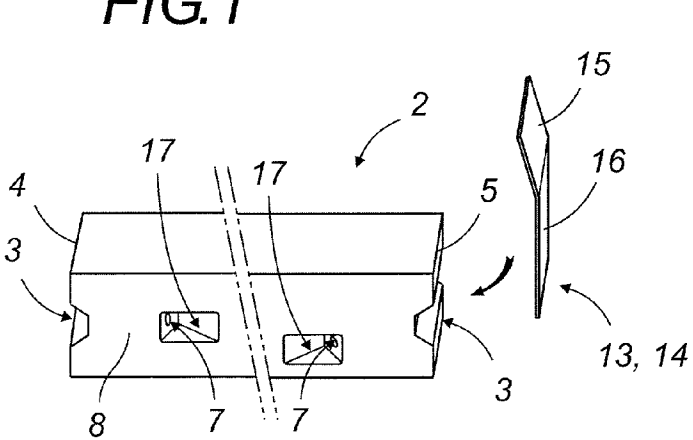

FIG. 2 represents the placement of the next flat prefabricated element 2 beside the preceding one already on the ground by moving in vertical translation against external surface 16 of vertical guide element 13. This process of placing the next flat prefabricated element 2, which is generally just as heavy as the preceding one, preferably takes place using a crane (not shown).

Figure 3:
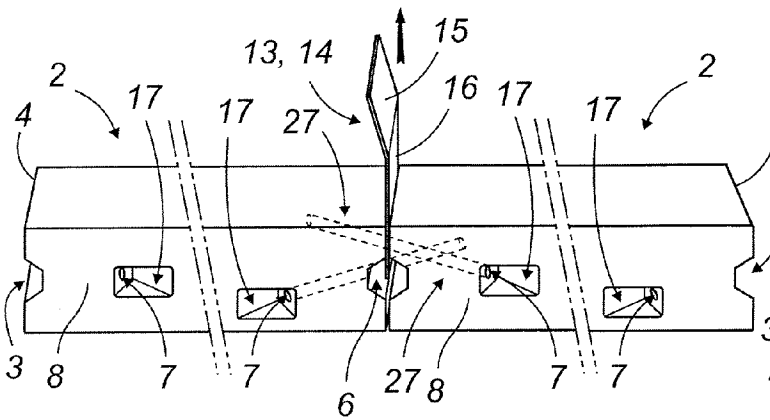
Figure 4:
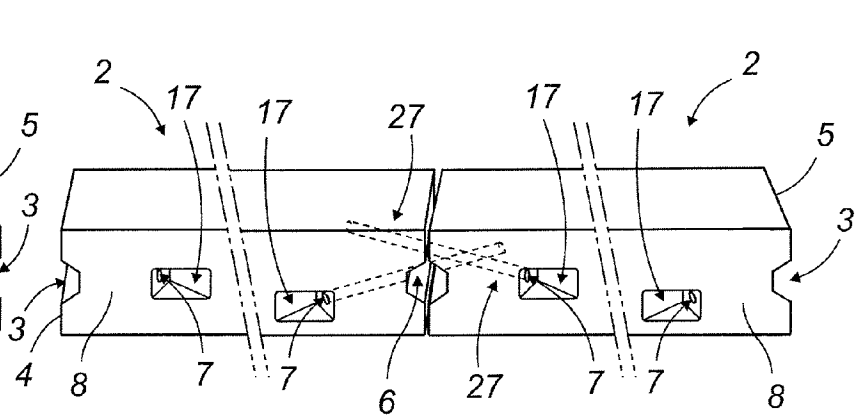

Once flat prefabricated element 2 is positioned on the ground, the vertical guide element 13 can be withdrawn, as shown in FIG. 3. As a result, the two flat prefabricated elements 2 are positioned on the ground, as shown in FIG. 4, and are ready to be assembled using connection system 1.

Figure 5:
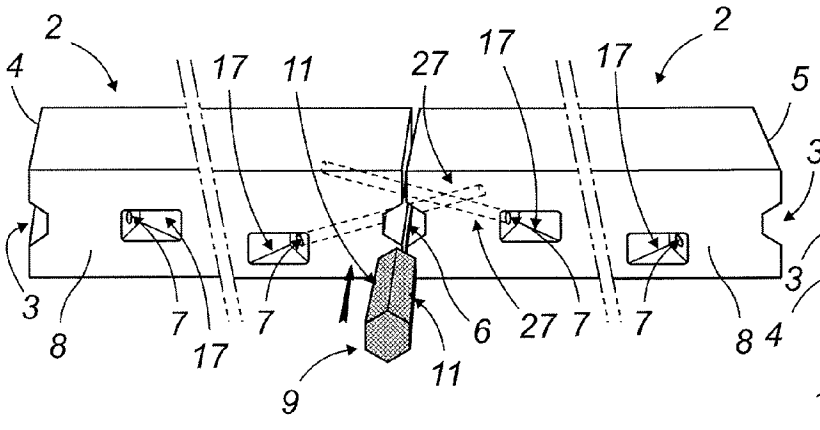
Figure 8:
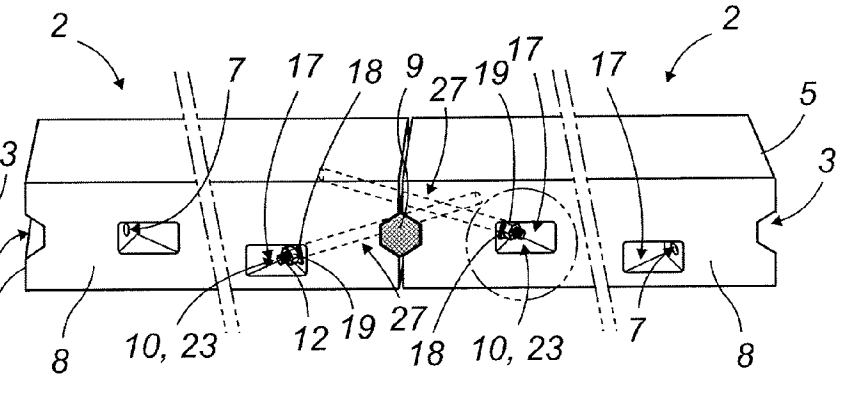

A transverse insert 9 is then introduced into transverse housing 6 formed by the junction of two transverse channels 3 facing flat prefabricated elements 2, as shown in FIG. 5.

Figure 6:
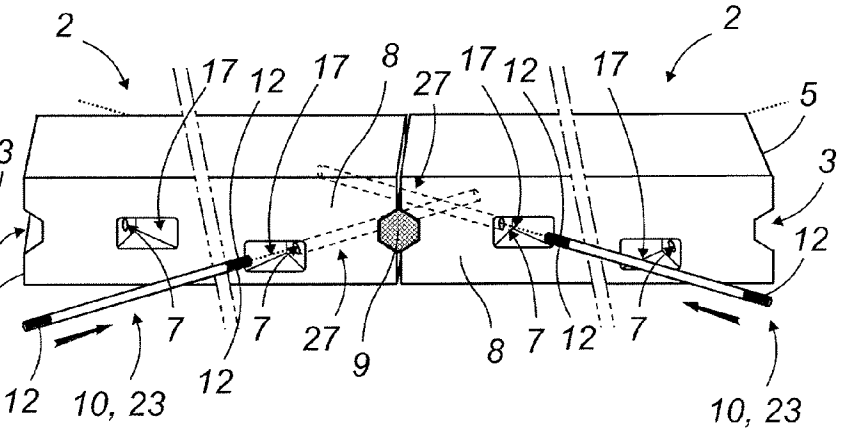
FIGS. 5 through 8 represent the steps of assembling two flat prefabricated elements positioned, one after the other, using the connecting system that is part of the invention.

A guiding means 10 in the form of a tie beam 23 is then introduced into each passage conduit 27 formed by associating the extensions of two passage conduits 7 for the guiding means 10 of one of the flat prefabricated elements 2 to emerge on the other side of each passage conduit 7 for guiding means 10 of the flat prefabricated element 2 beside it. As shown in FIG. 6, the two tie beams 23 may also be engaged on the same side by introducing them on the same side into passage conduits 27 of the two flat prefabricated elements 2, which produces the same result but may be more practical if one of the lateral surfaces 8 of one of the flat prefabricated elements 2 is difficult to access.

Once introduced into their respective passage conduits 27, the guiding means 10 in the form of tie beams 23 have their extremities projecting outside passage conduits 27. If it is not desired for the extremities of tie beams 23 to project beyond lateral surfaces 8 of the flat prefabricated elements 2, these elements may include a recess 17 at the level of the extremities of each passage conduit 27, which is shown in the different drawings. The extremities of tie beams 23 are thus unexposed and do not project from flat prefabricated elements 2, therefore, they pose no danger to people nearby.

Once guiding means 10, in the form of tie beams 23, are positioned, the tie beams are then subjected to tension from the tensioning means located at the extremities of tie beams 23 and the tie beams are immobilized, preventing retraction of tie beams 23 from passage conduits 7, 11, 27 where they are attached and thus maintaining and locking the connection between the two flat prefabricated elements.

Figure 7:
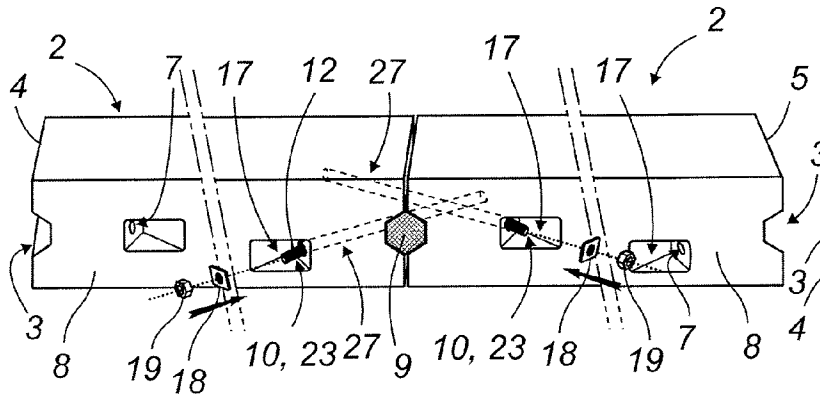
Figure 9:
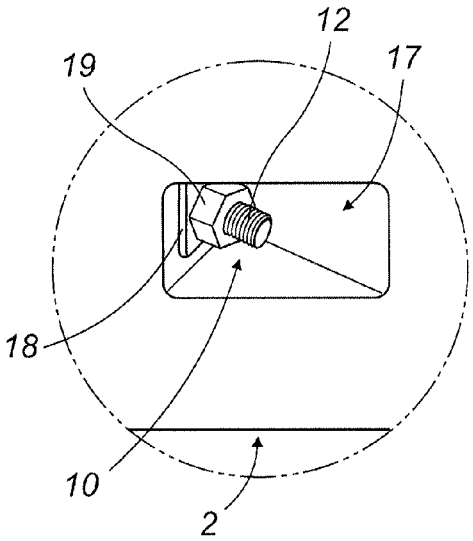
FIG. 9 is an enlarged view of the circled detail in FIG. 8.
Figure 10:
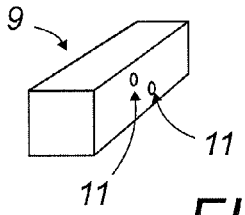
FIGS. 10 through 14 represent different examples of the shape of the section of transverse insert.
Figure 11:
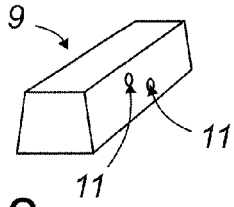
Figure 12:
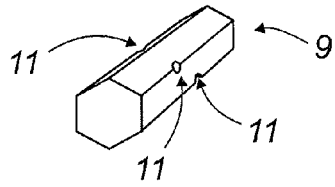
Figure 13:
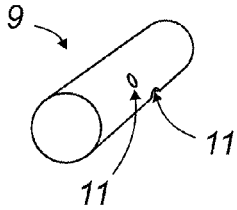
Figure 14:
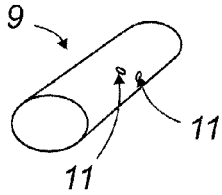

In a preferred embodiment of the invention, the means for exerting tension and maintaining the assembly are screws 19, one screw 19 being attached to each of the threaded extremities 12 of tie beams 23. A washer 18 is preferably introduced on each extremity prior to attaching a screw 19 to it, as shown in FIG. 7.

By exerting tension on guiding means in the form of tie beams 23, attaching the screws 19 compresses transverse insert 9 and maintains the connection of the two flat prefabricated elements 2 like a lock. By tightening certain screws 19 more than others, it is possible to adjust slightly the position of one flat prefabricated element 2 relative to the other, as previously mentioned above.

Figure 15:
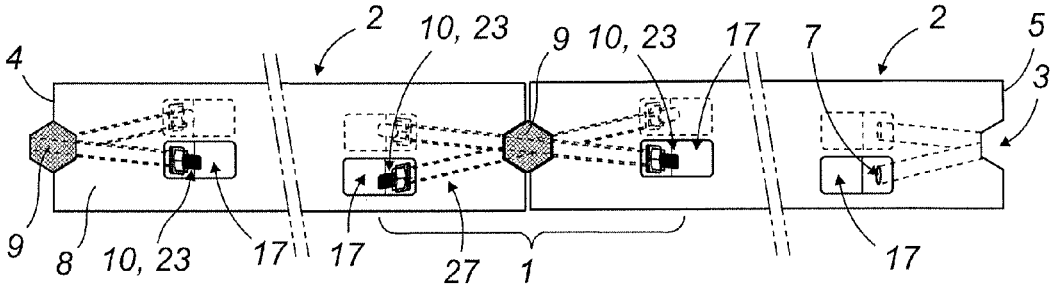
FIG. 15 is a profile view of two flat prefabricated elements assembled using the connecting system that is part of the invention comprising rectilinear tie beams.
Figure 16:
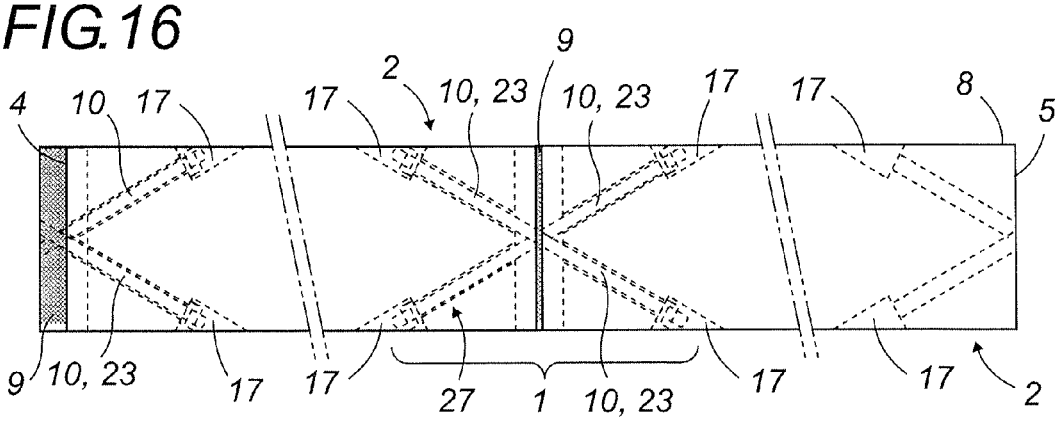
FIG. 16 is an overhead view of two flat prefabricated elements assembled using the connecting system that is part of the invention comprising rectilinear tie beams.

FIGS. 15 and 16 respectively show the profile and the top of flat prefabricated elements 2 assemble according to the method shown in FIGS. 1 through 8. In these drawings, certain hidden elements are shown in transparency by broken lines.

Figure 17:
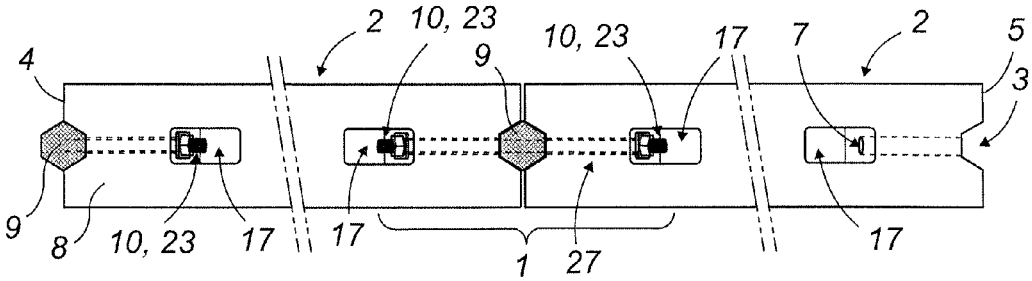
FIG. 17 is a profile view of two prefabricated flat elements assembled using the connecting system that is part of the invention comprising curved tie beams forming an arc.
Figure 18:
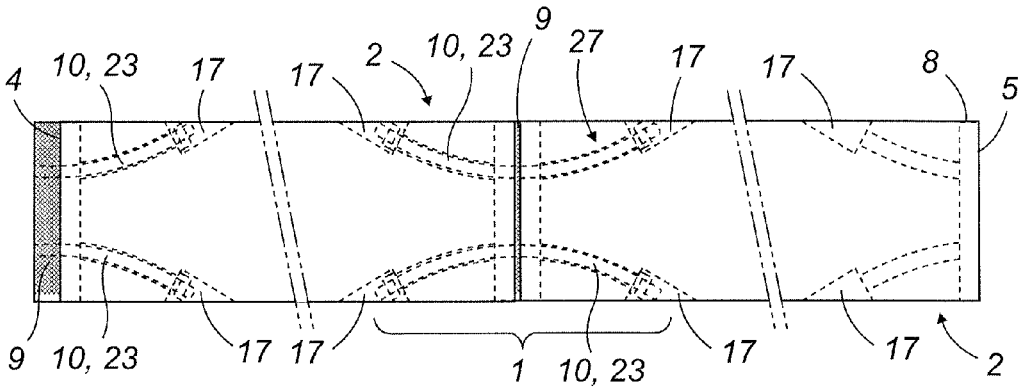
FIG. 18 is an overhead view of two flat prefabricated elements assembled using the connecting system that is part of the invention comprising curved tie beams forming an arc.

FIGS. 17 and 18 respectively show the profile and the top of flat prefabricated elements 2 assembled according to the connection system 1 of the invention in which the rectilinear tie beams 23, of FIGS. 15 and 16, are replaced by curved, arched tie beams 23.

It is apparent that the invention is not limited to the preferred embodiments described previously and shown in the different drawings, since a person skilled in the art might make numerous modifications and conceive of other embodiments without departing from the either scope or the realm of the invention.

Thus, although we have shown flat prefabricated elements that are generally parallelepipedal in order to simplify the drawings, the invention applies to and can be adapted to flat prefabricated elements of any other shape.

Similarly, the tensioning means formed of screws for attachment to the threaded extremities of the guiding means could be replaced by any other similar means.

Moreover, although the invention advantageously uses the same transverse insert to simultaneously form a seal and a deformable connection, it is possible to separate these two functions by using separate transverse elements for insertion into the housing provided for the transverse insert. Finally, the transverse insert is not necessarily made of a single unitary piece, although that is advantageous, particularly for forming a seal and for rapid positioning, but it may be formed of two or more pieces.

The invention claimed is:

1. A junction between two successive prefabricated elements for creating a roadway for a vehicle, the junction comprising:

at least one connection system (1) and two successive flat prefabricated elements (2) for assembly on the ground in a linear succession and generally coplanar, the successive flat prefabricated elements (2) to be assembled each having at least one transverse end edge (4, 5) and two longitudinal lateral surfaces (8), the at least one transverse end edge (4, 5) of one of the successive flat prefabricated elements (2) being situated, after assembly, facing the edge of the flat prefabricated element (2) succeeding the successive flat prefabricated elements (2), wherein the junction of the successive elements comprises:

at least one transverse housing (6) formed by the junction of two transverse channels (3) each formed in the at least one transverse end edge (4, 5) of the successive flat prefabricated elements (2);

at least one passage conduit (27) formed by associating the extension of two conduits (7) each made in one of the successive flat prefabricated elements (2) and each opening on one side at the transverse end edge (4, 5) and, on the other side, at one of upper and lower longitudinal lateral surfaces (8) of the prefabricated element (2);

at least one flexible transverse insert (9) designed to be placed in at least one transverse housing (6) and extend essentially across an entire width of at the least one transverse housing (6);

at least one guiding means (10) to be located inside at least one of the passage conduits (27);

tensioning means for the at least one guiding means (10); and means for maintaining the assembly of the two successive flat prefabricated elements (2).

2. The junction of elements according to claim 1, wherein the means for exerting tension are also means for maintaining tension and the assembly of two successive flat prefabricated elements (2) in a locked manner.

3. The junction of elements according to claim 1, wherein the flexible transverse insert (9) has at least one passage conduit (11) which passes therethrough and which opens, on one side, at the transverse end edge (4, 5) of one of the flat prefabricated elements (2) and, on the other, at the transverse end edge (5, 4) of the other flat prefabricated element (2) to be assembled, opposite the conduits (7).

4. The junction of elements according to claim 3, wherein the guiding means (10) passes through the at least one of the passage conduits (11) in the transverse insert (9).

5. The junction of elements according to claim 1, wherein the guiding means (10) is long enough that each of the guiding means (10) extends beyond the flat prefabricated elements (2), on one side, at one of the lateral longitudinal surfaces (8), upper or lower, of one of the flat prefabricated elements (2) and, on the other, at one of the lateral longitudinal surfaces (8), upper or lower, of the other flat prefabricated element (2).

6. The junction of elements according to claim 1, wherein the tensioning means are located at the extremities of the guiding means (10).

7. The junction of elements according to claim 1, wherein the tensioning means block the guiding means (10) from retreating beyond the passage conduits (7, 27) to which the guiding means (10) are attached.

8. The connection system according to claim 1, wherein the passage conduits (11), in the transverse insert (9), are diagonal conduits.

9. The junction of elements according to claim 8, wherein the passage conduits (11) pass through the transverse insert (9) essentially along its center.

10. The junction of elements according to claim 9, wherein the passage conduits (11) cross essentially at the center of the transverse insert (9), but without splitting.

11. The junction of elements according to claim 1, wherein the transverse insert (9) is a horizontal insert.

12. The junction of elements according to claim 1, wherein the guiding means (10) have threaded extremities (12) which cooperate with screws (19) and washers (18), and the guiding means (10) are subjected to tension by rotation of the screws (19) at at least one of their extremities (12).

13. The junction of elements according to claim 1, wherein the guiding means (10) are tie beams (23) which are each formed as a straight metal rod.

14. The junction of elements according to claim 1, wherein the guiding means (10) are tie beams (23) which are each formed as a curved metal rod that forms an arc.

15. The junction of elements according to claim 1, wherein the guiding means (10) are manufactured from a flexible metal.

16. The junction of elements according to claim 1, wherein the guiding means (10) are tie beams (23) formed from a metal strap.

17. The junction of elements according to claim 1, wherein the transverse insert (9) is made of a flexible, watertight polymer material.

18. The junction of elements according to claim 17, wherein the transverse insert (9) is made from one of rubber, polyurethane resin, or recycled tires.

19. The junction of elements according to claim 1, wherein the transverse insert (9) has one of a hexagonal, a square, a trapezoidal, a round or an oval transverse cross section.

20. The junction of elements according to claim 1, wherein the junction is used for assembling prefabricated road elements (2, 20).

21. The junction of elements according to claim 20, wherein the prefabricated road elements (2, 20) are prefabricated elements (2, 20) forming one of a roadway or a travel pathway for a vehicle.

22. The junction of elements according to claim 21, wherein the prefabricated road elements (2, 20) are prefabricated elements (2, 20) forming a roadway or a travel pathway for a vehicle on traveling on tires on a central guide rail.

23. A method of assembling successive first and second flat prefabricated elements (2) on the ground in linear succession for creating a roadway for a vehicle, the junction comprises at one connection system (1) and the successive first and second flat prefabricated elements (2) for assembly on the ground in a linear succession and generally coplanar, the successive first and second flat prefabricated elements (2) to be assembled each having at least one transverse end edge (4, 5) and two longitudinal lateral surfaces (8), the at least one transverse end edge (4, 5) of the successive first flat prefabricated elements (2) being situated, after assembly, facing the edge of the succeeding second flat prefabricated elements (2), the junction of the successive first and second flat prefabricated elements (2) comprises at least one transverse housing (6) formed by the junction of two transverse channels (3) each formed in the at least one transverse end edge (4, 5) of the successive first and the second flat prefabricated elements (2), at least one passage conduit (27) formed by associating the extension of two conduits (7) each made in one of the successive first and the second flat prefabricated elements (2) and each opening on one side at the transverse end edge (4, 5) and, on the other side, at one of upper and lower longitudinal lateral surfaces (8) of the successive first and the second prefabricated element (2), at least one flexible transverse insert (9) designed to be placed in at least one transverse housing (6) and extend essentially across an entire width of at the least one transverse housing (6), at least one guiding means (10) to be located inside at least one of the passage conduits (27), tensioning means for the at least one guiding means (10); and means for maintaining the assembly of the successive first and the second flat prefabricated elements (2); the method comprising the steps of:

a. placing the first flat prefabricated element (2) on the ground;

b. placing the second flat prefabricated element (2) on the ground following the first flat prefabricated element (2) such that the two transverse end edges (4, 5) facing the successive first and the second flat prefabricated elements (2) are in immediate proximity to each other;

c. introducing the transverse insert (9) into the transverse housing (6) formed by the junction of two transverse channels (3) facing the successive first and the second flat prefabricated elements (2);

d. introducing respective guiding means (10) into each of the opposing passage conduits (7, 11); and e. putting in place tensioning means and subjecting the guiding means (10) to tension.

24. The method of assembly according to claim 23, further comprising the steps of, during the step of placing the second flat prefabricated element (2) on the ground, using a vertical guide means (13) of predefined thickness, which is placed vertically against a transverse end edge (5) of the first flat prefabricated element already placed on the ground in order to vertically guide the positioning of the second flat prefabricated element (2) on the ground following the first flat prefabricated element (2), at a predefined distance from the first flat prefabricated element (2) corresponding to the thickness of the vertical guide means (13), withdrawing the vertical guide means (13) after the second flat prefabricated element (2) is placed on the ground, and the vertical guide means (13) is a metal plate (14) of predefined thickness with the upper portion (15) angled toward the flat prefabricated element (2) already placed on the ground such that its external surface (16) serves as a vertical guide during the positioning of the successive second flat prefabricated element (2).

* * * * *